US005625913A

United States Patent [19]

Singleton

[11] Patent Number: 5,625,913

[45] Date of Patent: May 6, 1997

[54] OSCILLATORY BED

[76] Inventor: William H. Singleton, 4118 Timbervale Dr., Evergreen, Colo. 80439

[21] Appl. No.: 623,158

[22] Filed: Mar. 28, 1996

Related U.S. Application Data

[63] Continuation-in-part of Ser. No. 195,290, Feb. 14, 1994, Pat. No. 5,502,853.

[51] Int. Cl.[6] ..... A47B 7/00

[52] U.S. Cl. ..... 5/609; 5/617; 5/430

[58] Field of Search ..... 5/607–609, 613, 5/617, 429, 430, 109

[56] References Cited

U.S. PATENT DOCUMENTS

| | | | |
|---|---|---|---|
| 840,284 | 1/1907 | Adler | 5/109 |
| 1,644,043 | 10/1927 | Tiedemann | 5/607 |
| 2,239,821 | 4/1941 | Knox | 5/607 |
| 3,210,778 | 10/1965 | Robinson | 5/907 |

FOREIGN PATENT DOCUMENTS

| | | | |
|---|---|---|---|
| 210469 | 4/1956 | Australia | 5/607 |

*Primary Examiner*—Flemming Saether
*Attorney, Agent, or Firm*—Edwin H. Crabtree; Ramon L. Pizarro; Donald W. Margolis

[57] ABSTRACT

An oscillatory bed for providing improved patient care in a hospital, nursing home or home health care setting by shifting a person's weight in order to reduce or eliminate problems encountered in convalescence or bed confinement. The subject oscillatory bed is characterized by having a removable cradle assembly received on top of a bed frame assembly. The cradle assembly may be oscillated by a microprocessor controlled electric motor or oscillated manually. The cradle assembly includes a cradle base attached at opposite ends to a semi-circular foot board and semi-circular head board. The bed frame assembly includes a pair of parallel longitudinal support members attached at opposite ends to a foot board support member and a head board support member. The foot board and head board support members include roller bearings mounted inside thereof for receiving the semi-circular foot board and head board thereon. In the motorized version of the bed the foot board support member includes a gear motor mounted within that engages a gear toothed or rubber friction equipped roller. The gear toothed or rubber friction equipped roller is used for engaging gear teeth or a rubberized friction strip around the circumference of the semi-circular foot board. When the gear motor is actuated the cradle assembly is rotated up to 40 degrees from the horizontal to either the right or left from an axis through the length of the bed.

20 Claims, 5 Drawing Sheets

OSCILLATORY BED

The subject application is a continuation-in-part application of patent application Ser. No. 08/195,290, title "BED FRAME WITH INDEPENDENTLY OSCILLATING CRADLE" filed on Feb. 14, 1994, having a common inventor, William H. Singleton which is now U.S. Pat. No. 5,502,853.

BACKGROUND OF THE INVENTION (a) Field of Invention

This invention relates to beds, but more specifically to patient and convalescent beds used in the care of persons who have restricted mobility, limited abilities of movement, pulmonary complications, and more particularly, but not by way of limitation, to patient convalescent beds which oscillate on a longitudinal axis.

Heretofore, the need for an improved patient care apparatus, in particular in the form of a convalescent bed which helps alleviate various physical and medical problems associated with persons who are confined to bed for extended periods, has long been recognized. The difficulties and secondary trauma resulting from such confinement are well documented. Many problems arise when a person's body remains in a prone position without movement for extended periods of time. Restricted movement of the body can cause pooling of fluids in the lower portions of the body resulting in a high risk of pneumonia, respiratory infections and other pulmonary problems induced by the stagnation of bodily fluids.

Another significant side effect is the formation of decubitus ulcers (pressure or bed sores) on the prominences of the body which come in direct and continuous contact with the bed surface. These unpleasant, large and very painful sores can form in a matter of hours if the patient is not moved on a regular basis and pose a serious health problem. Persons confined to bed for prolonged periods with restricted movement may also experience atrophied muscle tissue.

It has long been recognized by medical personnel that regular turning of the body, so that its weight rests on different longitudinal sectors (i.e. the left side, the back and the right side), will significantly reduce or prevent the negative effects of continuous, localized pressure on the body caused by being confined to bed. Manual turning, while effective, is at best cumbersome and, since patients usually can not assist in the turning, often causes injury to both the patient and to those performing the turning. Manual turning is very labor intensive, and in a hospital or nursing home may not always be accomplished at the necessary intervals. In the home care setting, manual turning requires the almost continuous presence of family or health care personnel, increasing both time and financial burdens.

(b) Description of the Prior Art

Heretofore there have been a variety of oscillatory patient beds, cradle bed flames, rocking bed structures and the like which are discussed in detail in U.S. Pat. No. 5,103,511 to Sequin. The patents mentioned in the Sequin patent are incorporated herein by reference. None of the prior art patents discussed in the Sequin patent (U.S. Pat. No. 5,103,511), disclose or teach the unique features and combination of structure with added advantages for improved patient care as compared to the subject oscillatory bed described herein.

SUMMARY OF THE INVENTION

An objective of the present invention is to provide an oscillating bed that will deliver the benefits of rotation and in which a patient can be mechanically turned both safely and comfortably. The bed may be oscillated by a microprocessor controlled electric motor, which includes a foot operated clutch for disengagement of the motor for manual repositioning or emergencies. Alternatively, another version of the bed is manually oscillated. In this case, a foot operated caliper brake is used to hold a removable cradle assembly securely in place when it is not being turned and to release the cradle assembly for rotation.

Another feature of the oscillatory bed is the cradle assembly which includes a semi-circular foot board and semi-circular head board that are received in a bed frame assembly including a foot board support member and a head board support member. The bed frame assembly includes a pair of parallel longitudinal support members attached at opposite ends to the foot board support member and the head board support member. The foot board and head board support members each include a cavity in which roller bearings are mounted for receiving the semi-circular foot board and head board, allowing the cradle assembly to rotate up to 40 degrees either to the left or right of a longitudinal axis through the length of the bed.

Another object of the invention is the ability to lift the cradle assembly upward and separate it from the bed frame assembly. The cradle assembly and the bed frame assembly can then be turned on their sides for ease in transporting and passage through small entrances. The bed is light-weight for ease in handling, transporting and installation.

Still another feature of the invention is a cradle, base which is part of the cradle assembly and includes a cradle head panel mounted and hinged to the cradle base so that it can be raised by a linear actuator up to 40 degrees above the horizontal plane of the cradle base. This is called a semi-Fowlers position. Raising of a patient's head and upper torso is desirable in many medical treatments, as well as for patient comfort, and is provided by the subject bed.

Another object of the invention is a cradle assembly utilizing hinged, curved side panels along opposite sides of the length of the cradle assembly. The curved side panels can be raised from a flattened horizontal position to form a "U" shaped cradle configuration during the operation of the bed. The adjustable cradle assembly configuration encompasses the patient's body, preventing the patient from sliding and reducing the possibility of shear, which can lead to the breakdown of the skin during oscillation. Each curved side panel can independently swing upward to a total of 85 degrees from a horizontal position and is infinitely adjustable to any location within this range. The adjustable curved side panels can be quickly lowered to a flattened position for entrance and exit, emergency treatment, changing bed linens, bathing the patient, etc.

Another feature of the microchip controlled, motorized bed is that the foot board support member includes a gear motor for engaging a gear toothed or rubber friction roller. The gear toothed or rubber friction roller is used for engaging gear teeth or a rubber friction strip attached around the circumference of the semi-circular foot board. When the gear motor is actuated, the cradle assembly is rotated up to 40 degrees from the horizontal either to the left or right of an axis through the length of the bed.

Yet another feature of the microchip controlled, motorized oscillatory bed is electronic controls that allow two oscillating cradle options: (1) continuous oscillation with cycle times programmable by the care provider, or (2) oscillation that can be directed to stop for interval periods which are programmable by the care giver. The interval stops are located at the horizontal position, a raised right or raised left position. It has been found therapeutically beneficial in many cases to be able to stop the bed's oscillation at programmed intervals at the designated stops rather than operate in continuous oscillation.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the, prior art.

BRIEF DESCRIPTION OF THE DRAWINGS

The accompanying drawings illustrate complete preferred embodiments of the present invention according to the best modes presently devised for the practical application of the principles thereof, and in which:

In FIG. 8, a retractable safety rail is shown in a retracted position on the curved side panel and in an extended position in FIG. 9.

DESCRIPTION OF THE PREFERRED EMBODIMENT

Figure 1:
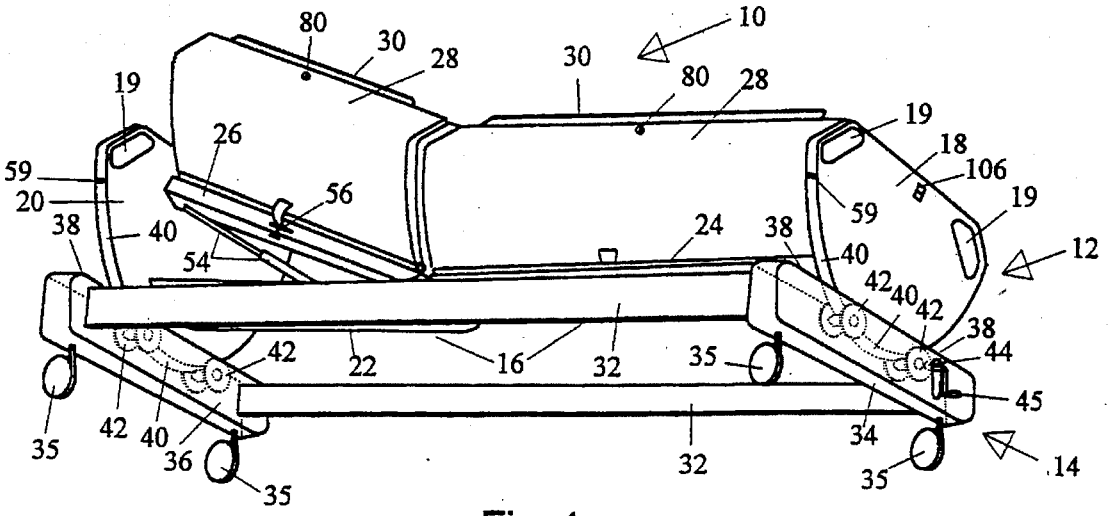
FIG. 1 illustrates a perspective view of a manually operated oscillatory bed with cradle head panel shown in a raised, semi-Fowlers position and a portion of semi-circular foot board and head board shown in dotted lines received on roller bearings mounted within foot board and head board support members.

In FIG. 1 a perspective view of the oscillatory bed is shown having general reference numeral 10. The bed 10 in this drawing is operated manually and includes a removable cradle assembly having general reference numeral 12 and a bed frame assembly having general reference numeral 14.

Figure 3:
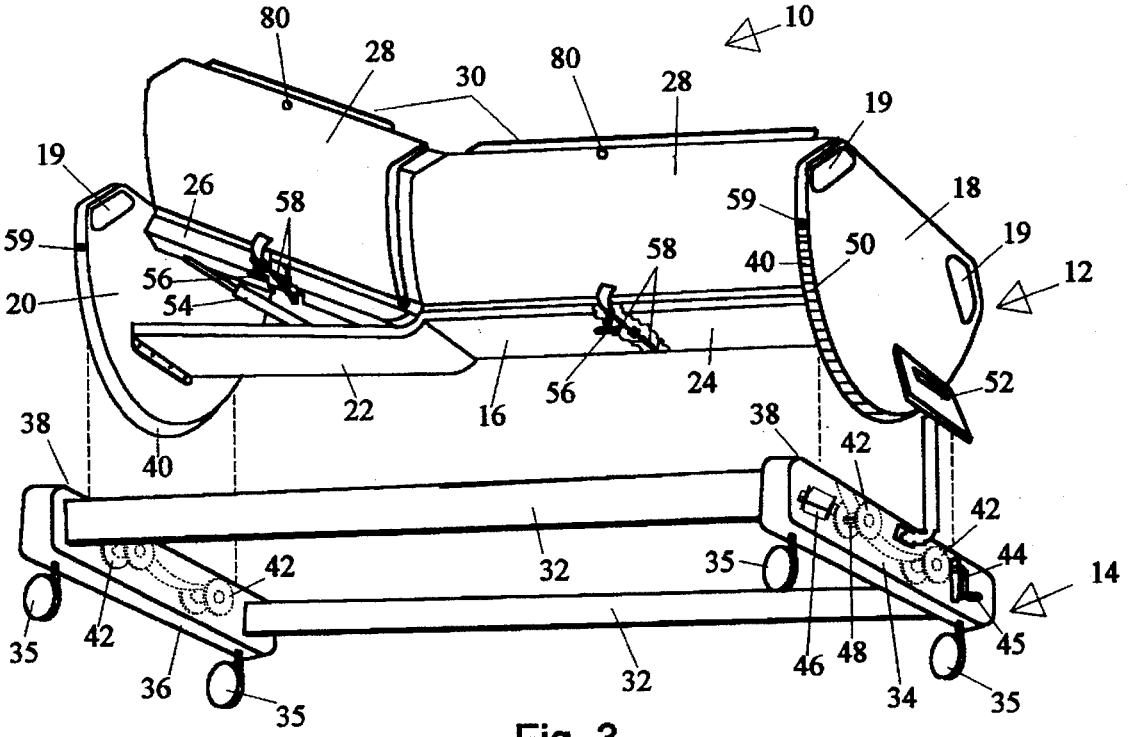
FIG. 3 illustrates a perspective view of an electric motor operated oscillatory bed with the cradle assembly raised above the bed frame assembly in preparation for removal or assembly.

The cradle assembly 12 broadly includes a cradle base 16 attached at opposite ends to a semi-circular foot board 18 and a semi-circular head board 20. Both the semi-circular foot board 18 and semi-circular head board 20 include handle openings 19 in the top thereof which are used for lifting the removable cradle assembly 12 from the bed frame assembly 14 as shown in FIG. 3. The cradle base 16 includes an upper cradle portion 22 and a lower cradle portion 24. A cradle head portion 26 is hinged to the upper cradle portion 22. Adjustable, curved side panels 28 are pivotally attached to the opposite sides of the cradle head portion 26 and the lower cradle portion 24. Each curved side panel 28 includes a retractable safety rail 30 which is discussed in detail under FIGS. 8 and 9.

The bed frame assembly 14 includes a pair of longitudinal parallel frame members 32 having opposite ends attached to a foot board support member 34 and a head board support member 36. The foot board support member 34 and head board support member 36 have two locking casters 35 on the bottom thereof for ease in moving the bed 10 and for retaining it in place when not being moved. A top portion 38 of the foot board support member 34 and head board support member 36 has a cavity therein for receiving semi-circular sides 40 of the foot board 18 and head board 20. A portion of the semi-circular sides 40 is shown in dotted lines inside the cavity. Mounted inside the cavity are roller bearings 42 for receiving the semi-circular sides 40 of the foot board 18 and head board 20 thereon. In the case of the manually oscillated bed 10 shown in FIG. 1, a roller bearing 42 in the cavity of the foot board support member 34 is engaged by a caliper break 44 with a foot operated caliper break release arm 45. When the break release arm 45 is in a raised position as shown, the caliper break 44 engages the side of one of the roller bearings 42 and the removable cradle assembly 12 is prevented from oscillation on the bed frame assembly 14. When the release arm 45 is lowered by depressing with the foot, the roller bearing 42 is released from engagement with the caliper break 44 and the removable cradle assembly 12 is free to oscillate.

Figure 2:
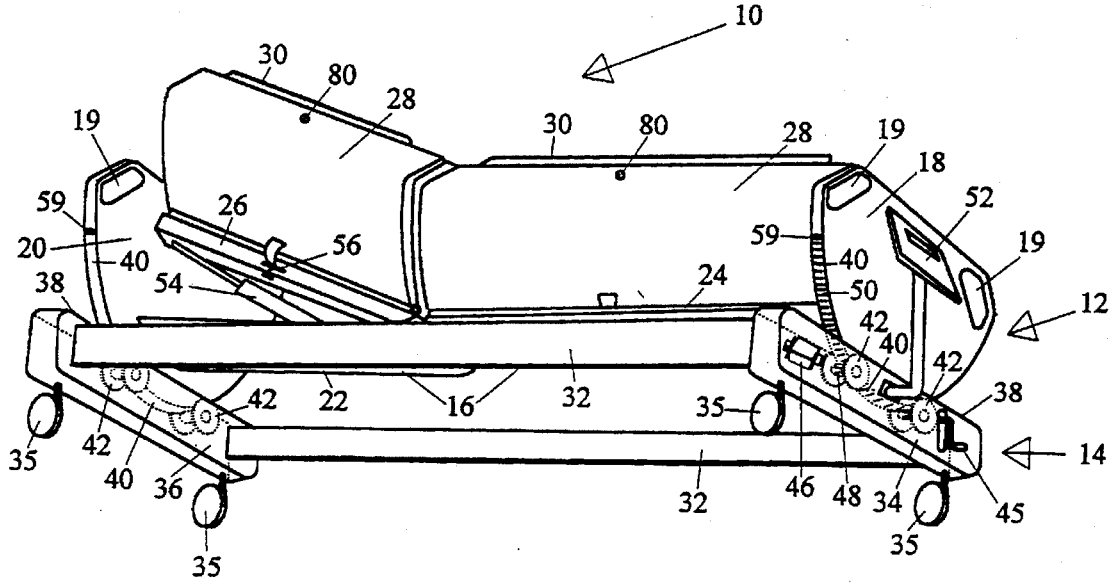
FIG. 2 illustrates a perspective view of a microprocessor controlled, electric motor driven oscillatory bed with a cradle head panel shown in a raised, semi-Fowlers position. Portions of a semi-circular foot board and head board are shown in dotted lines and received on roller bearings mounted within foot board and head board support members. The illustration also depicts a gear motor mounted within the foot board support member for powering the rotation of the cradle assembly from the foot board, and a control panel mounted on the foot board support member containing a microprocessor which controls the electrical and electronic functions of the bed.

In FIG. 2, the oscillatory bed 10 is shown with a microprocessor controlled, motorized power source. Mounted in the cavity in the foot board support member 34 is an electric motor 46 having a drive shaft connected to one of the roller bearings 42. The roller bearing 42 includes a drive gear or rubberized friction drive 48 which engages a plurality of gear teeth or a rubberized friction strip 50 disposed around the circumference of the semi-circular sides 40 of the foot board 18. The electric motor 46 is electrically connected to a microprocessor located in control panel 52 which is mounted to the front of the foot board support member 34. When the electric motor 46 is energized using the control panel 52, the electric motor 46 oscillates the cradle assembly 12 on the bed frame assembly 14.

The electric motor 46 assembly includes a clutch mechanism that is not shown and is activated by depressing the foot operated release arm 45. When the release arm 45 is in the raised position as shown, the clutch mechanism is engaged and the electric motor 46 can drive the rotation of the cradle assembly 12 on the bed frame assembly 14. When the release arm 45 is lowered by depressing with the foot, the clutch within the electric motor 46 is disengaged, freeing the cradle assembly for manual positioning.

In FIG. 3, the removable cradle assembly 12 is shown raised above the bed frame assembly 14. In this drawing the cradle base 16 with upper cradle portion 22 and lower cradle portion 24 can be seen more clearly. The cradle head portion 26 is raised and lowered above the upper cradle portion 22 using a linear actuator 54. The cradle head portion 26 is shown in a raised semi-Fowlers position wherein a patient using the subject oscillatory bed 10 has his or her upper body raised upwardly approximately 40 degrees from the horizontal. By activating the linear actuator 54 the cradle head portion 26 can be raised to various positions from the horizontal upward to 40 degrees. Lowering and raising the cradle head portion 26 is accomplished by powering the linear actuator 54 which is controlled by an electrical rocker switch 106 located either on a control panel 52 in the case of the motorized bed 10, or recessed in the surface of the foot board 18 in the manual version. This switch will be discussed under FIG. 11.

Figure 4:
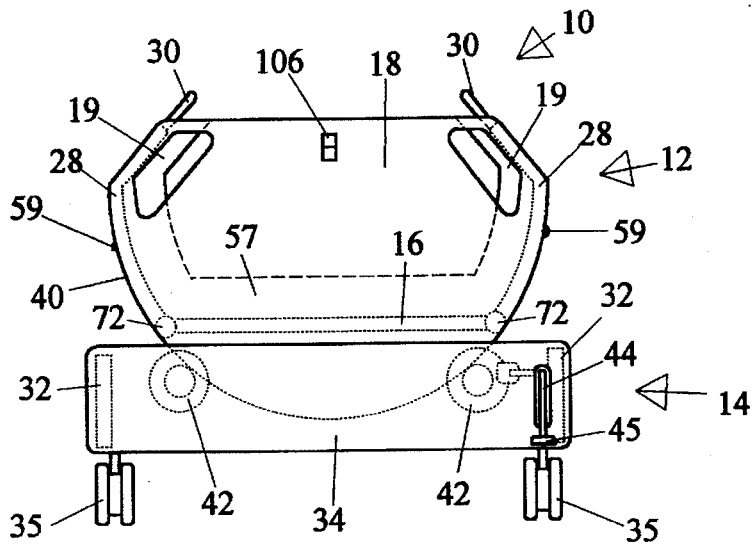
FIGS. 4 and 5 illustrate a view from the foot of the manual oscillatory bed wherein curved side panels of the cradle assembly are adjusted in an upright closed position up to 85 degrees from the horizontal as shown in FIG. 4, and fully opened into a horizontal position as shown in FIG. 5.
Figure 5:
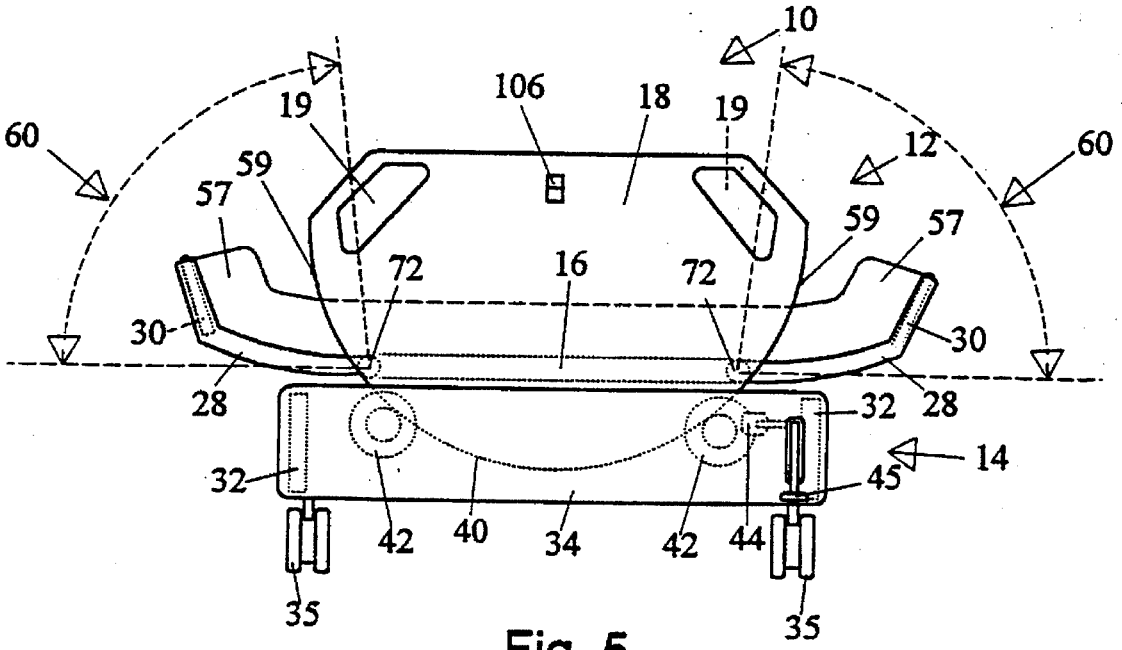

In FIG. 3 a portion of the cradle head portion 26 and the lower cradle portion 24 have been cut away to expose the gas cylinders 58 connected to the curved side panels 28. Pulling upward on a side panel release lever 56 opens a valve within the enclosed gas cylinder 58 and the curved side panels 28 attached thereto can be raised or lowered as shown in FIGS. 4 and 5. Pulling a side panel release lever 56 opens a valve in the associated gas cylinder 58, allowing captivated gas to escape through the valve past an "0" ring retainer to the opposite side of the enclosed gas cylinder 58. As long as the side panel release lever 56 is pulled, the valve inside the gas cylinder 58 remains open allowing gas to move from one side of the gas cylinder 58 to the other, and the curved side panel 28 is free to be moved upward or downward within the arc shown as arrow 60 in FIG. 5. Releasing the side panel release lever 56 stops the movement of the curved side panel 28 and holds it in the position attained.

The adjustment range of the curved side panels 28 allows for a flattening of the removable cradle assembly 12 for cleaning and emergencies as shown in FIG. 5. By adjusting the curved side panels 28 upward as shown in FIG. 4, the patient is encompassed and retained in a desired position during oscillation, thereby restricting any sliding movement of the patient's body. The adjustment of the; curved side panels 28 is made to accommodate the patient and provide the most comfortable and effective position for oscillation, based upon patient size and therapeutic needs. Adjustment of these curved side panels 28 also reduces any shearing motion or damage to the patient's skin that could result from sliding during oscillation.

In FIGS. 4 and 5, a view of the bed 10 is seen from the front of the semi-circular foot board 18. In FIG. 4 the curved side panels 28 are seen in a raised closed position on the removable cradle assembly 12 and are represented by dotted lines. By pulling a side panel release lever 56 located under the curved side panels 28 on either side of the cradle base 16, each of the four curved side panels 28 can be raised or lowered from a position of 85 degrees above the horizontal downward to a horizontal position as shown in FIG. 5. In FIGS. 4 and 5 the cradle base 16 is shown with a segmented mattress or pressure reduction surface 57 thereon. The movement from the, open horizontal position upward to closed position of 85 degrees is shown as arrow 60 in FIG. 5.

Figure 6:
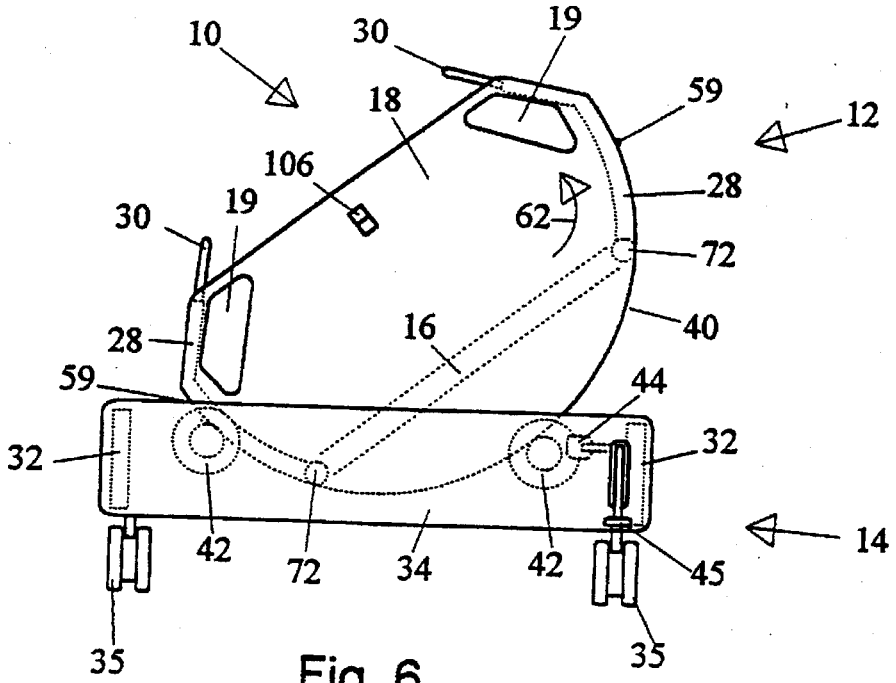
FIGS. 6 and 7 illustrate a view from the foot of the manual oscillatory bed wherein the cradle assembly on the bed frame is rotated 40 degrees from the horizontal to the right of an axis through a length of the bed as shown in FIG. 6, and rotated 40 degrees from the horizontal to the left as shown in FIG. 7.
Figure 7:
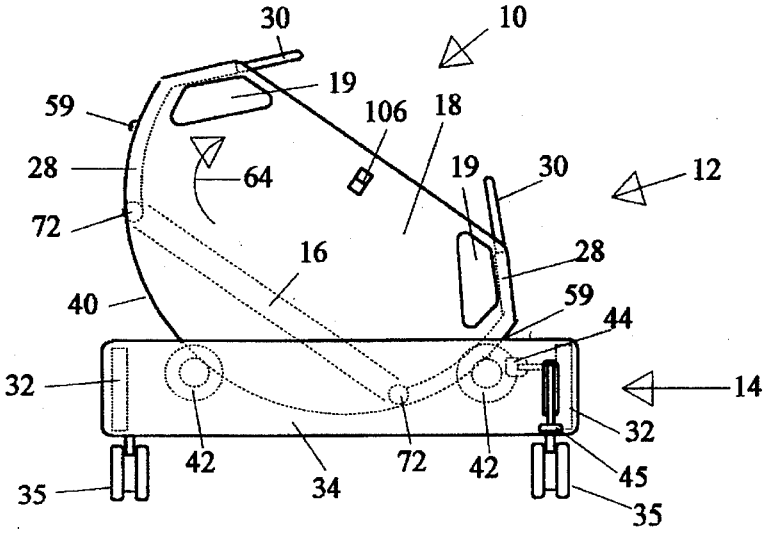

In FIGS. 6 and 7, a view of the bed 10 is again seen from the front of the semi-circular foot board 18. In FIG. 6 the removable cradle assembly 12 has been rotated upwardly to the right 40 degrees from the horizontal on roller beatings 42, as indicated by arrow 62 on an axis through the length of the bed. The longitudinal axis of the bed is not shown in the drawings. In FIG. 7 the cradle assembly 12 is shown rotated upward to the left 40 degrees from the horizontal., as indicated by arrow 64. The removable cradle assembly 12 can oscillate on the bed frame assembly 14 upward to 40 degrees in either direction from the horizontal before engaging stops 59 near the top of the semi-circular sides 40 of the foot board 18 and head board 20.

Figure 8:
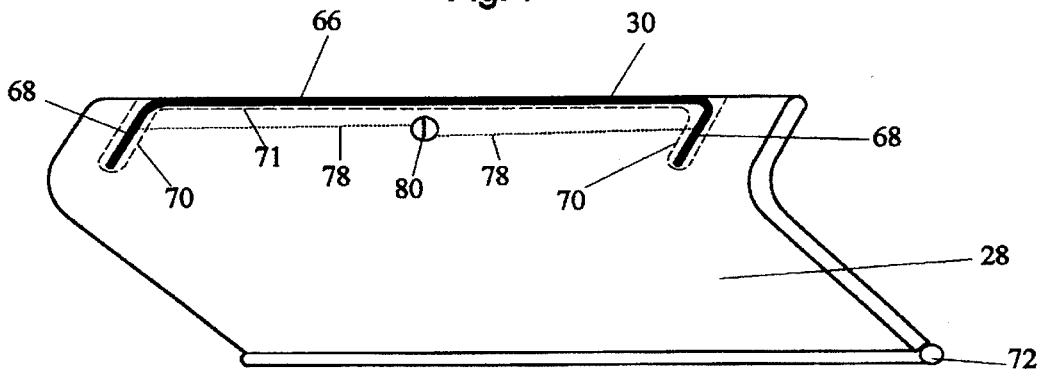
FIGS. 8 and 9 illustrate a perspective view of one of the curved side panels from the cradle assembly.
Figure 9:
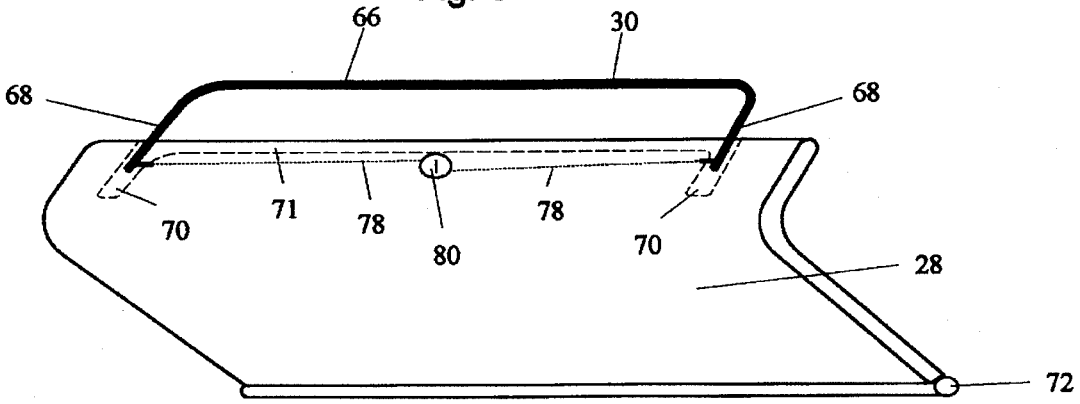

In FIGS. 8 and 9 an enlarged perspective view of one of the curved side panels 28 is shown. In FIG. 8 the retractable safety rail 30 is shown in a retracted position on the top of the curved side panel 28. The retractable safety rail 30 includes an elongated horizontal bar 66 with downward extending extension arms 68. The extension arms 68 are received in a pair of sleeves 70 in the top of curved side panels 28. In FIG. 8 the elongated horizontal bar 66 is received into a cavity 71 on top of curved side panels 28. In FIG. 9, the retractable safety rail 30 is shown extended upwardly from the top of curved side panels 28. Note that a hinge 72 is located at the bottom of the curved side panel 28 which is attached to opposite sides of the lower cradle portion 24 and the cradle head portion 26 for raising and lowering the curved side panels 28 as shown in FIGS. 4 and 5.

Figure 10:
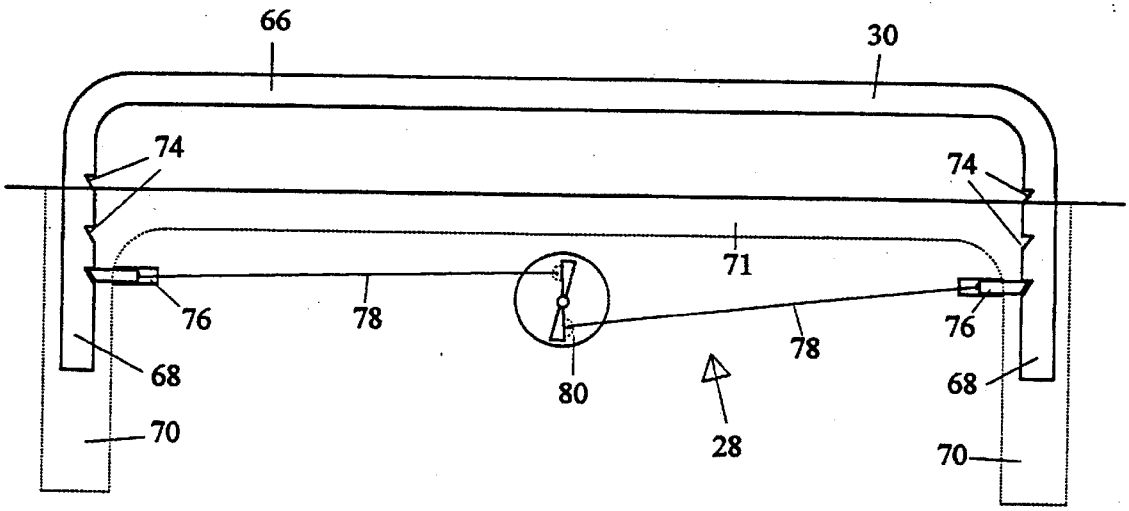
FIG. 10 illustrates a from view of the retractable safety rail with spring latches and a release lever. The safety rail is shown in a fully extended position.

In FIG. 10, a front view of one of the retractable safety rails 30 is shown with the extension arms 68 received in the sleeves 70 of the curved side panels 28. The extension arms 68 include a plurality of notches 74 along the length of the extension arms 68 for receiving one end of the latch 76. The latch 76 is attached at one end to a linkage cable 78. The other end of the linkage cable 78 is attached to a safety rail lever 80 mounted in the side of the curved side panels 28. Because the latch 76 is spring activated and angular on the lower side, the safety rail 30 can be raised by lifting upward on the elongated horizontal bar 66 and the latches 76 will encounter each notch 74 as the extension arms 68 progress to the maximum extension. By selecting different notches 74 along the length of the extension arms 68 the safety rail 30 height can be adjusted to alternative levels. By rotating the safety rail lever 80 the latches 76 are released from the notches 74 and the retractable safety rail 30 can be lowered to different levels or fully recessed within the curved side panels 28.

Figure 11:
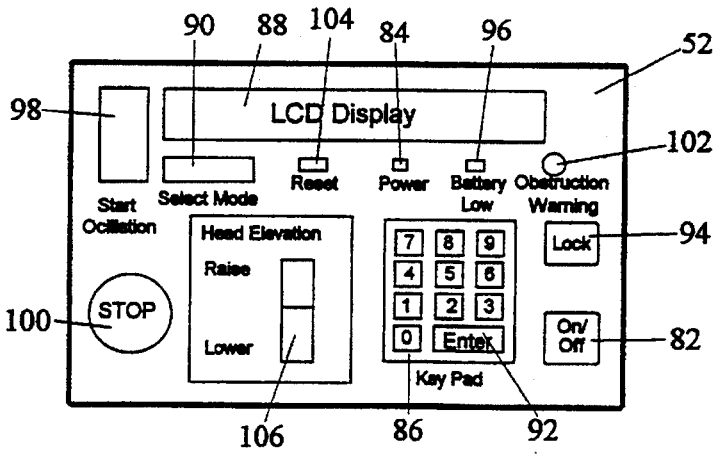
FIG. 11 illustrates a front view of a control panel mounted to the foot board support member in front of the semi-circular foot board.

In FIG. 11, a front view of the control panel 52 is shown, which incorporates a microprocessor which is not shown. The control panel 52 is used with the motorized version of the oscillatory bed 10 which utilizes microprocessor control and an electric motor 46 for oscillating the removable cradle assembly 12. An ON/OFF switch 82 is provided to supply the electrical power to the microprocessor located in the control panel 52 and through it to the electric motor 46 and the linear actuator 54 of the oscillatory bed 10. A power on indicator light 84 is provided, which is; illuminated when the ON/OFF switch 82 is on.

The microprocessor is programmable by the care provider through a key pad 86 and the various keys located on the key pad 86. Immediately upon activating the electrical power, the care giver will automatically be prompted to "select mode" on the LCD display if no programming exists in the microprocessor's memory or if a change existing programming is desired. The operator must select one of the following modes based on the therapy prescribed by a medical professional.

CONTINUOUS MODE—the cradle assembly 12 will oscillate in up to an 80 degree are (40 degrees from horizontal in either direction), completing up to a 160 degree full cycle at various speeds selected by the care giver.

INTERVAL MODE—the cradle assembly 12 may be programmed to oscillate and stop at three positions the right side (FIG. 6), the horizontal (FIG. 4), and the left side (FIG. 7). The stop duration and degree of rotation at each of these positions is variable and may be selected by the care giver.

Display of these two options automatically alternates on the LCD display 88 each time the select mode key 90 is depressed. T o select the alternate mode the care giver must again depress the select mode key 90. Upon releasing the select mode key 90, whichever mode is currently displayed on the LCD display 88 is selected by depressing an enter key 92.

Next the care provider will be prompted to input the oscillation or stop times and degree of rotation depending upon the mode selected. The times in minutes and degrees of rotation desired are entered through the key pad 86 and then by depressing the enter key 92. Each required entry is automatically prompted in the LCD display 88 dependent upon on the mode selected. When all required entries are completed, programmed selections may now be locked into the microprocessor memory by depressing a lock key 94. The selections are retained in the microprocessor memory until changed by the care giver. A battery backup will maintain these selections in the microprocessor for a period of 48 hours (if the rechargeable battery is fully charged) even when the electrical power is turned off An automatic battery charger is incorporated in the control panel 52 assembly. A battery low indicator light 96 is located in the front of the control panel 52 and illuminates should the battery charge be lower than a specified charge level.

The rotation of the removable cradle assembly 12 on the bed frame assembly 14 may now be started by depressing the start oscillation key 98. The oscillation will continue until stopped by depressing a stop key 100, or by the cradle assembly 12 encountering an obstruction. Should the cradle assembly 12 encounter an obstruction causing a prescribed degree of resistance, an electronic pressure sensor located in the drive mechanism signals the electric motor 46 to shut down. The cradle assembly 12 will then automatically stop and an obstruction light 102 will flash until the obstruction is removed and the microprocessor reset by depressing the reset key 104.

To raise or lower the cradle head portion 26, a head elevation raise/lower rocker switch 106 connected electrically to the linear actuator 54 is depressed on the "up" side to raise and the "down" side is depressed to lower. In the microprocessor controlled, motorized bed this switch 106 is located in the control panel 52 and recessed into the surface of the foot board 18 in the case of the manual bed.

While the invention has been particularly shown, described in detail with reference to the preferred embodiments and modifications thereof, it should be understood by those skilled in the art that equivalent changes in form and detail may be made therein without departing from the true spirit and scope of the invention as claimed, except as precluded by prior art.

The embodiments of the invention for which an exclusive privilege and property right is claimed are defined as follows:

1. An oscillatory bed with mattress or other pressure reduction surface for receiving a patient's lower body, upper body, and head thereon, the oscillatory bed comprising:

a bed frame assembly having a foot board support member and a head board support member, said support members joined together by a pair of longitudinal parallel support members;

a cradle assembly having an elongated cradle base, one end of said cradle base attached to a semi-circular foot board, another end of said cradle base attached to a semi-circular head board, said semi-circular foot board received into said foot board support member, said semi-circular head board received into said head board support member; and oscillating means mounted on said bed frame assembly for oscillating said cradle base assembly thereon and about a cradle base axis along the length of the cradle base, said cradle base assembly oscillated independently from said bed frame assembly.

2. The oscillatory bed as described in claim 1 wherein said cradle base is divided into an upper cradle portion with a cradle head panel and a lower cradle portion.

3. The oscillatory bed as described in claim 2 further including means for raising and lowering said cradle head panel on said upper cradle portion.

4. The oscillatory bed as described in claim 2 further including a pair of first curved side panels mounted on opposite sides of said cradle head panel and a pair of second curved side panels mounted on opposite sides of said lower cradle portion.

5. The oscillatory bed as described in claim 4 wherein said first side panels are pivotally mounted on opposite sides of said cradle head panel and said second side panels are pivotally mounted on the opposite sides of said lower cradle portion, said first and second side panels adapted for raising above a horizontal forming a U-shaped cross sectional configuration with said cradle base.

6. The oscillatory bed as described in claim 5 further including means for raising and lowering said first and second side panels on the opposite sides of said cradle head panel and said lower cradle portion.

7. The oscillatory bed as described in claim 5 wherein said first and second side panels include a recessed safety rail assembly mounted thereon, said safety rail assembly adjustable for raising and lowering into said panels to assure the patient's safety.

8. The oscillatory bed as described in claim 1 further including breaking means within said foot board support member for engaging said semi-circular foot board and retaining said cradle assembly in place while not rotating and means for releasing said breaking means from said semi-circular foot board for allowing rotation of said cradle assembly.

9. The oscillatory bed as described in claim 1 further including an electrical control panel connected to said oscillating means for controlling the oscillation of said cradle assembly in a continuous mode and in a mode with interval stops during the oscillations.

10. An oscillatory bed with mattress or other pressure reduction surface for receiving a patient's lower body, upper body, and head thereon, the oscillatory bed comprising:

a bed frame assembly having a foot board support member with a cavity therein and a head board support member with a cavity therein, said support members joined together by a pair of longitudinal parallel support members;

a cradle assembly having an elongated cradle base, one end of said cradle base attached to a semi-circular foot board, another end of said cradle base attached to a semi-circular portion of head board, a semi-circular portion of said foot board received into the cavity of said foot board support member and rotatably mounted thereon, a semi-circular said head board received into the cavity of said head board support member and rotatably mounted thereon; and oscillating means mounted in the cavity of said foot board support member and said head board support member for oscillating said cradle base assembly about a cradle base axis along the length of the cradle base, said cradle base assembly oscillated independently from said bed frame assembly.

11. The oscillatory bed as described in claim 10 wherein said oscillating means is a plurality of roller bearings mounted in the cavity of said foot board support member and said head board support member.

12. The oscillatory bed as described in claim 10 wherein said oscillating means is a plurality of roller bearings mounted in the cavity of said foot board support member and said head board support member and a drive motor for engaging and rotating one of said roller bearings.

13. The oscillatory bed as described in claim 12 further including an electrical control panel connected to said drive motor for controlling the oscillation of said cradle assembly in a continuous mode and in a mode with interval stops during the oscillations.

14. The oscillatory bed as described in claim 10 further including stops strategically located on said semi-circular foot board and said semi-circular head board for preventing said cradle assembly from rotating further than is deemed safe for the patient.

15. An oscillatory bed with mattress or other pressure reduction surface for receiving a patient's lower body, upper body, and head thereon, the oscillatory bed comprising:

a bed frame assembly having a foot board support member and a head board support member, said support members joined together by a pair of longitudinal parallel support members;

a cradle assembly having an elongated cradle base, one end of said cradle base attached to a semi-circular foot board, another end of said cradle base attached to a semi-circular head board, said semi-circular foot board received into said foot board support member, said semi-circular head board received into said head board support member, said cradle base divided into an upper cradle portion with a cradle head panel and a lower cradle portion;

means for raising and lowering said cradle head panel on said upper cradle portion; and oscillating means mounted on said bed frame assembly for oscillating said cradle base assembly thereon and about a cradle base axis along the length of the cradle base, said cradle base assembly oscillated independently from said bed frame assembly.

16. The oscillatory bed as described in claim 15 further including a pair of first curved side panels mounted on opposite sides of said cradle head panel and a pair of second curved side panels mounted on opposite sides of said lower cradle portion.

17. The oscillatory bed as described in claim 16 wherein said first side panels are pivotally mounted on opposite sides of said cradle head panel and said second side panels are pivotally mounted on the opposite sides of said lower cradle portion, said first and second side panels adapted for raising above the horizontal forming a U-shaped cross sectional configuration with said cradle base.

18. The oscillatory bed as described in claim 16 further including means for raising and lowering said first and second side panels on the opposite sides of said cradle head panel and said lower cradle portion.

19. The oscillatory bed as described in claim 16 wherein said first and second side panels include a recessed safety rail assembly mounted thereon, said safety rail assembly adjustable for raising and lowering into said panels to assure the patient's safety.

20. The oscillatory bed as described in claim 16 further including breaking means within said foot board support member for engaging said semi-circular foot board and retaining said cradle assembly in place while not rotating and means for releasing said breaking means from said semi-circular foot board for allowing rotation of said cradle assembly.

* * * * *